US009277323B2

(12) United States Patent
Locke et al.

(10) Patent No.: US 9,277,323 B2
(45) Date of Patent: Mar. 1, 2016

(54) COMPACT AUDIO SPEAKER

(71) Applicant: Apple Inc., Cupertino, CA (US)

(72) Inventors: Antony J. Locke, Cupertino, CA (US); Scott P. Porter, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 51 days.

(21) Appl. No.: 14/225,210

(22) Filed: Mar. 25, 2014

(65) Prior Publication Data

US 2015/0281846 A1 Oct. 1, 2015

(51) Int. Cl.

| | |
|---|---|
| ***H04R 19/00*** | (2006.01) |
| ***H04R 7/04*** | (2006.01) |
| ***H04R 1/00*** | (2006.01) |

(52) U.S. Cl.

CPC ... *H04R 7/04* (2013.01); *H04R 1/00* (2013.01)

(58) Field of Classification Search

CPC ..... H04R 2440/00–2440/07; H04R 1/08; H04R 9/08; H04R 11/04; H04R 17/02; H04R 21/02; H04R 1/00; H04R 2205/022; H04R 2201/401; H04R 2201/405; H04R 19/00; H04R 19/01; H04R 19/013; H04R 19/016; H04R 9/048; H04R 7/00; H04R 2207/00

USPC ..... 381/152, 176, 182, 191, 399, 429

See application file for complete search history.

(56) References Cited

U.S. PATENT DOCUMENTS

| | | | |
|---|---|---|---|
| 4,868,882 | A | 9/1989 | Ziegenberg et al. |
| 5,668,886 | A | 9/1997 | Sakamoto et al. |
| 5,841,880 | A | 11/1998 | Sakamoto |
| 6,600,399 | B1 | 7/2003 | Trandafir |
| 7,058,195 | B2 | 6/2006 | Trandafir |
| 7,317,810 | B2 | 1/2008 | Ohashi |
| 2012/0087523 | A1 | 4/2012 | Gerkinsmeyer |

FOREIGN PATENT DOCUMENTS

| | | |
|---|---|---|
| JP | 2006-217009 | 8/2006 |

*Primary Examiner* — Suhan Ni

(74) *Attorney, Agent, or Firm* — Blakely, Sokoloff, Taylor & Zafman LLP

(57) ABSTRACT

A audio speaker includes two parallel magnetically permeable plates and a diaphragm movably supported parallel to and approximately equidistant from the plates by a surround. A magnet assembly is coupled to the two magnetically permeable plates and passes through an opening in the diaphragm. The magnet assembly includes two magnets that are coupled with two like poles adjacent the diaphragm. A voice coil is coupled around the opening in the diaphragm to move the diaphragm when an electrical current flows in the voice coil. A suspension ring may surround a portion of the magnet assembly with a first end sealed to the diaphragm and an opposing second end sealed to one of the two plates to separate a back volume from a front volume. Some embodiments include several magnetic assemblies passing through the diaphragm with a voice coil and a suspension ring for each magnet assembly.

21 Claims, 4 Drawing Sheets

COMPACT AUDIO SPEAKER

BACKGROUND

1. Field

Embodiments of the invention relate to the field of electromagnetic audio speakers; and more specifically, to audio speakers having permanent magnets with like poles juxtaposed.

2. Background

Audio speakers use electrical signals to produce air pressure waves which are perceived as sounds. Many audio speakers use a diaphragm that is movably suspended in a frame. The diaphragm is coupled to a voice coil that is suspended in a magnetic field. The electrical signals representing the sound flow through the voice coil and interact with the magnetic field. This causes the voice coil and the coupled diaphragm to oscillate in response to the electrical signal. The oscillation of the diaphragm produces air pressure waves.

It is desirable for the audio speaker to displace a large volume of air relative to the volume of the audio speaker because the volume of air displaced determines the volume of the sound produced. Many audio speakers are used in compact devices such as personal music players and cellular telephones.

It would be desirable to provide an audio speaker that is compact in size with a form factor that is suitable for use in compact portable personal devices that can deliver a substantial volume of sound.

SUMMARY

A audio speaker includes two parallel magnetically permeable plates and a diaphragm movably supported parallel to and approximately equidistant from the plates by a surround. A magnet assembly is coupled to the two magnetically permeable plates and passes through an opening in the diaphragm. The magnet assembly includes two magnets that are coupled with two like poles adjacent the diaphragm. A voice coil is coupled around the opening in the diaphragm to move the diaphragm when an electrical current flows in the voice coil. A suspension ring may surround a portion of the magnet assembly with a first end sealed to the diaphragm and an opposing second end sealed to one of the two plates to separate a back volume from a front volume. Some embodiments include several magnetic assemblies passing through the diaphragm with a voice coil and a suspension ring for each magnet assembly.

Other features and advantages of the present invention will be apparent from the accompanying drawings and from the detailed description that follows below.

BRIEF DESCRIPTION OF THE DRAWINGS

The invention may best be understood by referring to the following description and accompanying drawings that are used to illustrate embodiments of the invention by way of example and not limitation. In the drawings, in which like reference numerals indicate similar elements.

DETAILED DESCRIPTION

In the following description, numerous specific details are set forth. However, it is understood that embodiments of the invention may be practiced without these specific details. In other instances, well-known circuits, structures and techniques have not been shown in detail in order not to obscure the understanding of this description.

Figure 1:
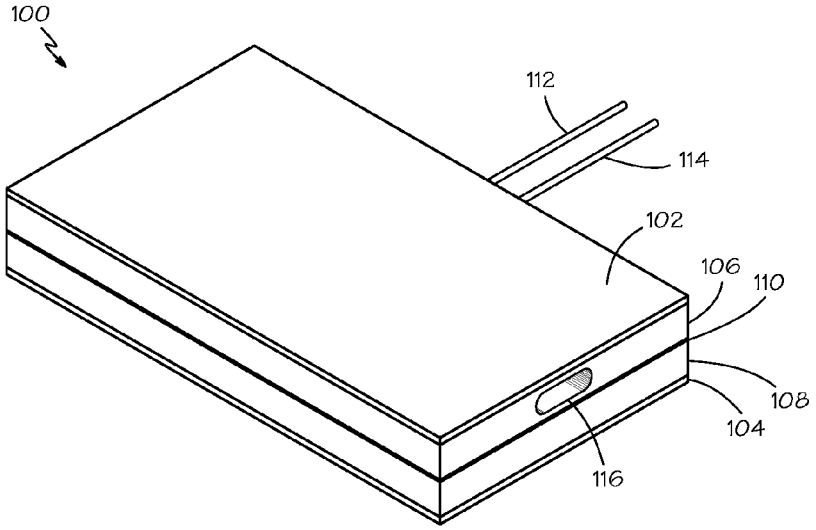
FIG. 1 is a pictorial view of an audio speaker.

FIGS. 1 through 5 show an audio speaker 100 that embodies the invention. As shown in FIG. 1, the audio speaker 100 may be provided in the form of a thin rectangular package that is suitable for use in compact portable personal devices. Profiles other than the rectangular profile shown may also be used.

The audio speaker 100 includes two magnetically permeable plates 102, 104. The two plates 102, 104 are supported by frame members 106, 108 in a parallel, spaced apart relationship.

A diaphragm 110 is supported by the frame members 106, 108 parallel to and approximately equidistant from the two magnetically permeable plates 102, 104. The frame members 106, 108 may also be magnetically permeable.

Figure 2:
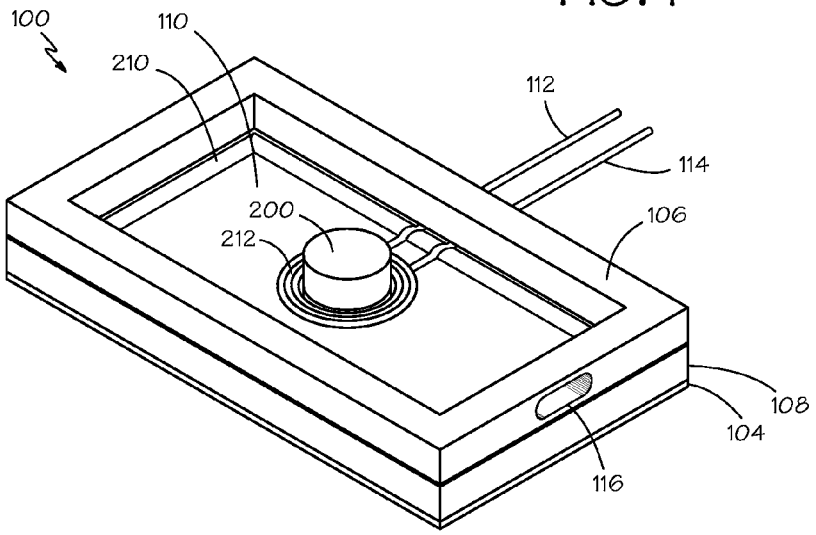
FIG. 2 is a pictorial view of the audio speaker of FIG. 1 with a top piece removed.

FIG. 2 shows the audio speaker 100 with the upper magnetically permeable plate 102 removed so that the diaphragm 110 is visible. A portion of the diaphragm 110 is a flexible surround 210 that allows the center portion of the diaphragm to move freely between the plates. The flexible surround 210 is an exemplary means for movably supporting the diaphragm and other means may be used to support the diaphragm with low resistance to movement. The outer periphery of the diaphragm 110 may be captured between the frame members 106, 108. The diaphragm 110 defines a front volume on a first side of the diaphragm and a back volume on a second side of the diaphragm opposite the first side.

Figure 4:
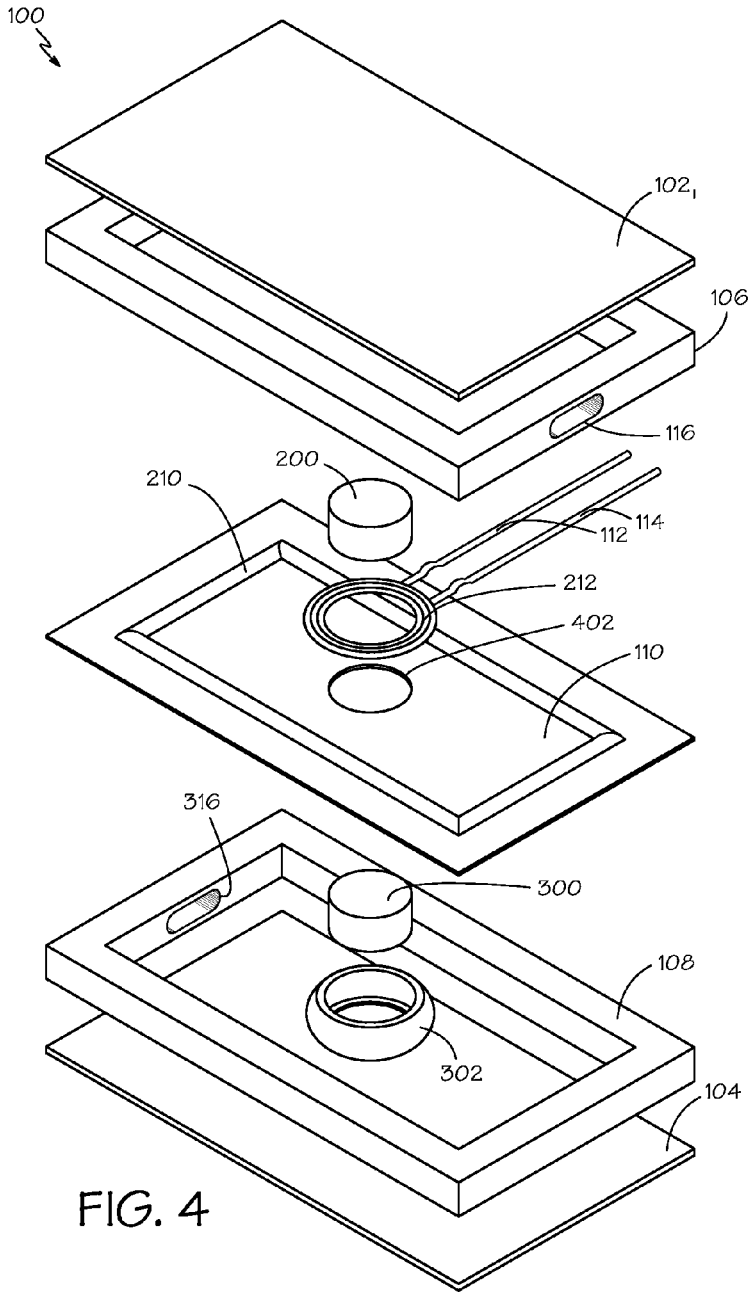
FIG. 4 is an exploded view of the audio speaker of FIG. 1.

FIG. 4 shows an exploded view of the audio speaker 100. A magnet assembly is coupled to the two magnetically permeable plates 102, 104. The magnet assembly includes two magnets 200, 300. The magnets pass through an opening 402 in the diaphragm.

Figure 5:
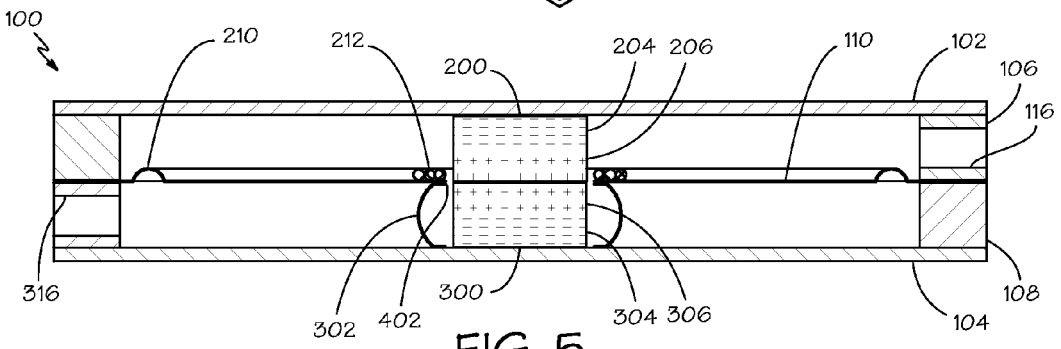
FIG. 5 is a cross-section view of the audio speaker of FIG. 1.

FIG. 5 shows an cross-section view of the audio speaker 100. The two magnets 200, 300 of the magnet assembly are coupled with two like poles 206, 306 adjacent the diaphragm 110. For example, the positive magnetic poles of the two magnets 200, 300 may be juxtaposed and the negative magnetic poles may be adjacent the two magnetically permeable plates 102, 104.

It will be appreciated that the two magnets 200, 300 will repel one another. The plates 102, 104 provide a clamping force to keep the two magnets is contact with each other. The plates 102, 104, the frame members 106, 108, and the two magnets 200, 300 provide a closed magnetic circuit.

As seen in FIGS. 2 and 4, a voice coil 212 is coupled to the diaphragm 110 surrounding the opening 402 in the diaphragm through which the magnet assembly passes. The voice coil 212 causes the diaphragm 110 to move between the plates 102, 104 when an electrical current flows in the voice coil. Leads 112, 114 extend from the voice coil 212 to the outside of the frame members 106, 108 for connection to a circuit that provides the electrical current to actuate the diaphragm.

A first opening 116 may be provided in the frame member 106 that surrounds the front volume. The first opening 116 provides an egress for the sound pressure waves created in the front volume by movement of the diaphragm 110. The first opening may be provided in other ways, such as by one or more openings in the magnetically permeable plate 102.

Figure 6:
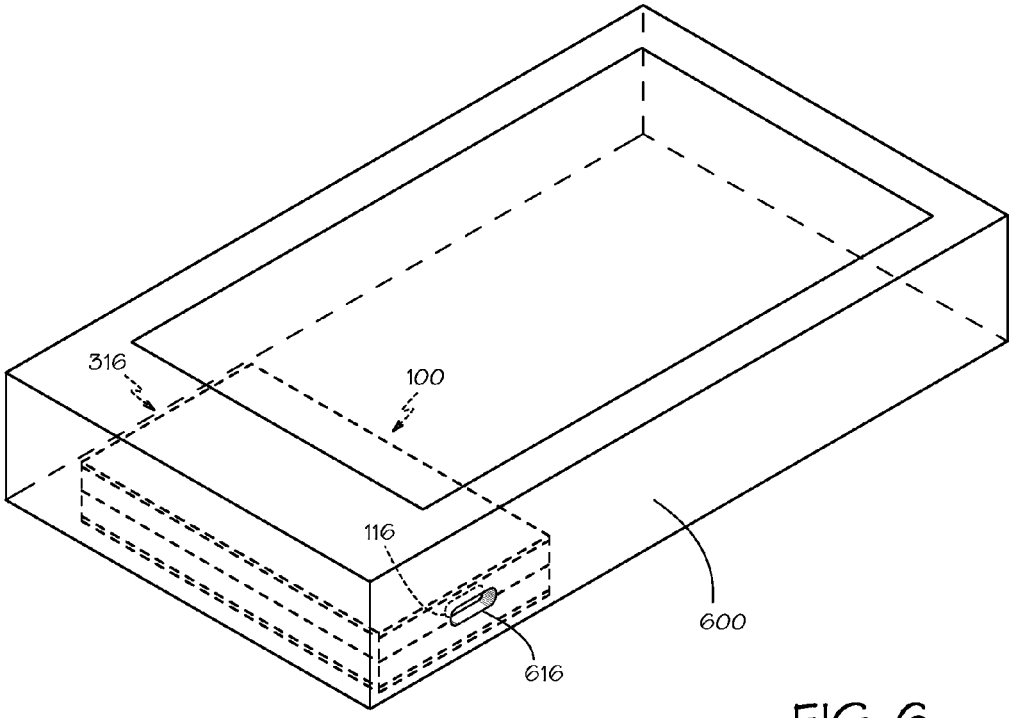
FIG. 6 is a pictorial view of a device that includes the audio speaker of FIG. 1 shown by hidden lines.

FIG. 6 shows the audio speaker 100 mounted in a device having a housing 600. If the audio speaker 100 is in a housing 600, the first opening 116 may provide a vent from the front volume to atmosphere that is coupled to a port 616 in a wall of the housing.

Figure 3:
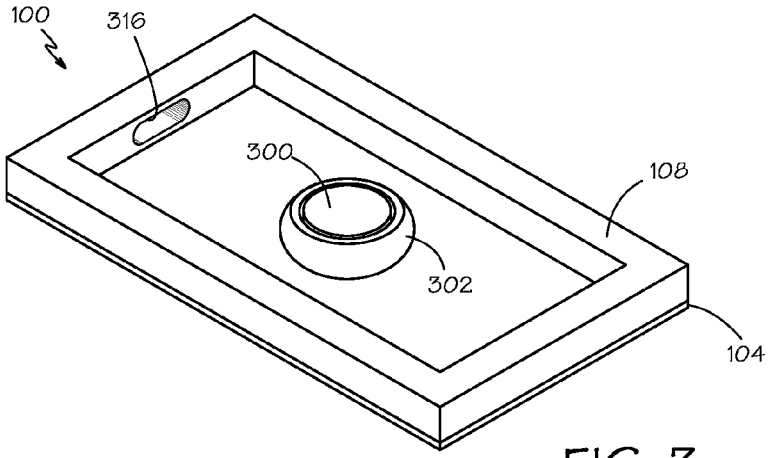
FIG. 3 is a pictorial view of the audio speaker of FIG. 2 with additional pieces removed.

FIG. 3 shows the audio speaker 100 with the diaphragm 110 removed so that the back volume is visible. It will be appreciated that leakage of air between the front volume and the back volume through the opening 402 in the diaphragm 110 through which the magnet assembly passes reduces the efficiency of the audio speaker 100. To reduce the leakage between the front volume and the back volume, a suspension ring 302 may be provided surrounding the lower magnet 300. A first end of the suspension ring 302 is sealed to the diaphragm 110 surrounding the opening 402 in the diaphragm. An opposing second end of the suspension ring 302 is sealed to the lower plate 104. Thus the suspension ring 302 separates the back volume from the front volume and reduces leakage between them.

A second opening 316 may be provided in the frame member 108 that surrounds the back volume. The second opening 316 provides an egress for the sound pressure waves created in the back volume by movement of the diaphragm 110. The opening may be provided in other ways, such as by one or more openings in the magnetically permeable plate 102. It will be appreciated that the sound pressure waves in the back volume are out of phase with the sound pressure waves in the front volume. If a second opening 316 is provided to the back volume, the second opening may vent the second side of the diaphragm to a closed volume in the housing 600 of the device in which the audio speaker 100 is mounted. The closed volume is sealed with respect to atmosphere. This arrangement prevents the sound pressure waves from the back volume from mixing with the sound pressure waves from the front volume.

In FIG. 6 the location of the second opening 316 is indicated although the second opening has been treated as being on a hidden side of the audio speaker 100 for clarity of the figure. In the embodiment shown in FIG. 6, the connection between the first opening 116 in the speaker and the port 616 in the wall of the housing is sealed so that the entire internal volume of the housing 600 is sealed with respect to atmosphere to provide the closed volume. In other embodiments, the closed volume is a portion of the interior of the housing and the connection between the second opening 316 in the speaker and the closed volume is sealed with respect to atmosphere.

Figure 7:
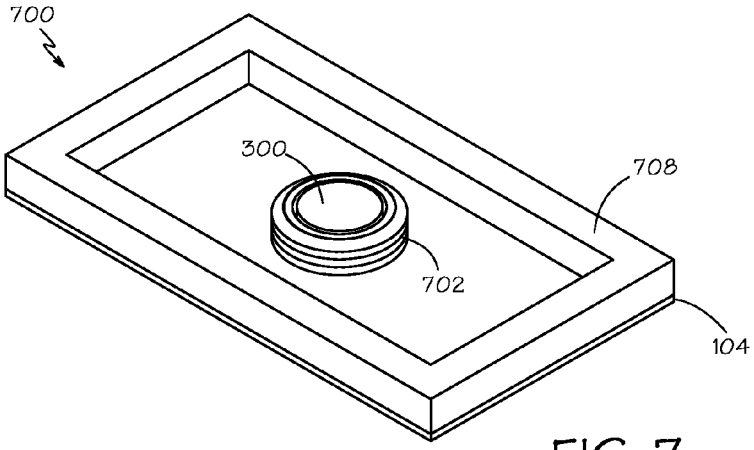
FIG. 7 is a pictorial view of another audio speaker with the top portion removed.

FIG. 7 shows another embodiment of an audio speaker 700. In this embodiment, the suspension ring 702 is pleated. This may reduce the amount of force the suspension ring 702 exerts on the diaphragm as it moves.

Figure 8:
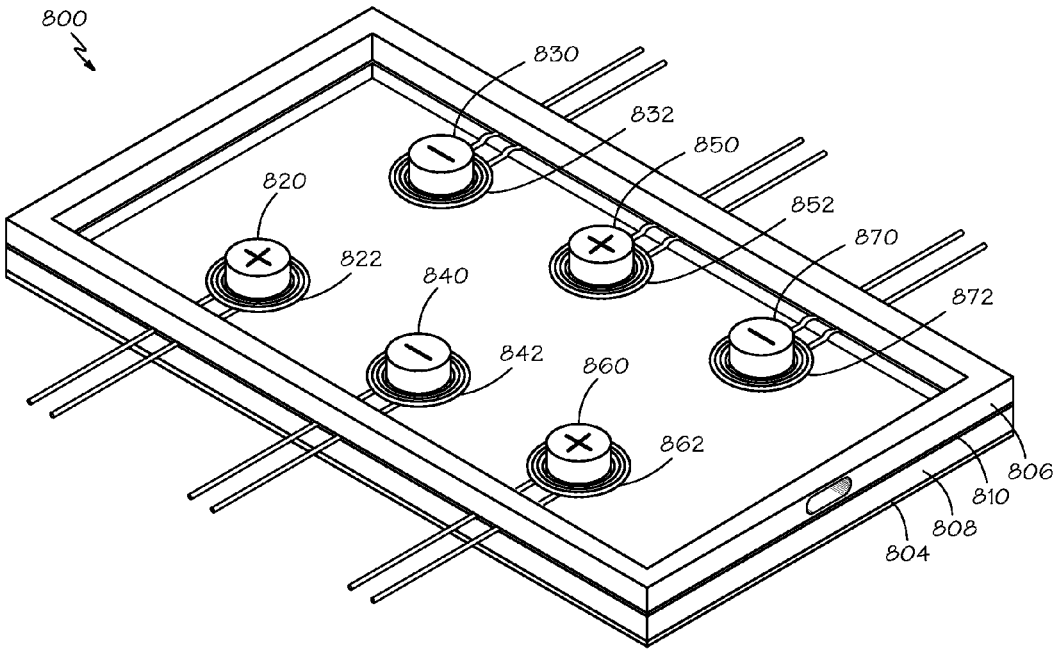
FIG. 8 is a pictorial view of yet another audio speaker with the top portion removed.

FIG. 8 shows another embodiment of an audio speaker 800. In this embodiment, a diaphragm 810 is supported between two frame members 806, 808. A second magnet assembly 820 and a third magnet assembly 860 are coupled to two magnetically permeable plates 804 (the upper is not shown for clarity) that are supported by the two frame members 806, 808. The second and third magnet assemblies 820, 860 are located such that the first magnet assembly 840 is between them. For the purposes of this description between is used to mean that the distance between the first magnet assembly and either the second or the third magnet assembly is less than the distance between the second and the third magnet assemblies.

In the embodiment of an audio speaker shown in FIG. 8, the first, second and third magnet assemblies 840, 820, 860 all lie on a straight line. In other embodiments this may not be the case. It will be appreciated that, for the purposes of this description, a first magnet assembly located at the vertex of a rectangle is between two magnet assemblies located at the adjacent vertices. For example, the magnet assembly identified by reference numeral 870 lies between the magnet assemblies identified by reference numerals 850 and 860.

The second and third magnet assemblies 820, 860 each include two magnets. The second and third magnet assemblies are coupled to two magnetically permeable plates with the two like poles adjacent the two magnetically permeable plates. Thus, the first magnet assembly has an opposite "polarity" from the second and third magnet assemblies with the two like poles of the first magnet assembly adjacent the diaphragm. As suggested by the symbols shown on the upper surfaces of the magnet assemblies, the first magnet assembly 840 is shown with the negative magnetic poles adjacent the two magnetically permeable plates. The second and third magnet assemblies 820, 860 are shown with the positive magnetic poles adjacent the two magnetically permeable plates.

The second and third magnet assemblies 820, 860 each pass through an additional opening in the diaphragm 810. Second and third voice coils 822, 862 are coupled to the diaphragm 810 and surround these additional second and third openings in the diaphragm through which the second and third magnet assemblies pass. While three magnet assemblies have been described for clarity, the embodiment shown includes six magnet assemblies 820, 830, 840, 850, 860 870. It will be appreciated that any three adjacent magnet assemblies of the six are arranged as described since the magnetic polarity is reversed between all adjacent magnet assemblies.

Other embodiments may use other numbers of magnet assemblies. This necessitates one opening in the diaphragm for each magnet assembly. A voice coil will surround each opening and interact with the magnet assembly that passes through the opening and surrounding voice coil. Using multiple magnet assemblies may allow the diaphragm to be moved with a motion that displaces a greater volume of air in proportion to the overall volume of the audio speaker.

Figure 9:
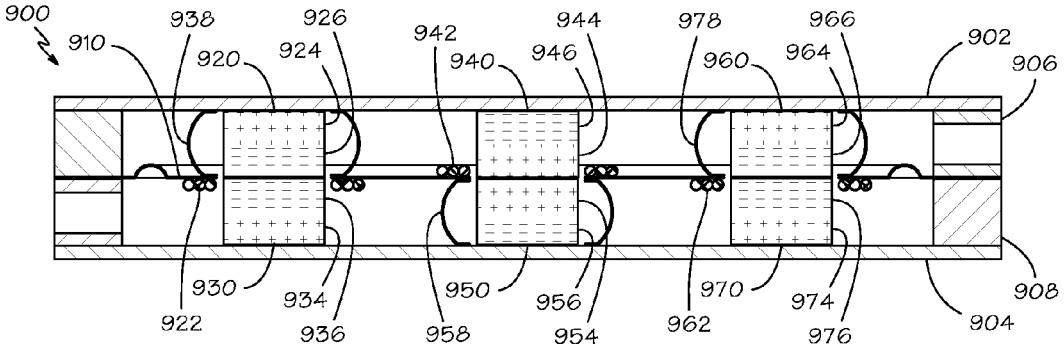
FIG. 9 is a cross-section view of another audio speaker.

FIG. 9 is a cross-section view of another audio speaker. The embodiment shown provides three magnet assemblies having upper magnets 920, 940, 960. It will be appreciated that this cross-section is similar to the three magnet assemblies found along the long edges of the embodiment shown in FIG. 8.

As previously discussed, each magnet assembly includes two permanent magnets having the ends with the same magnetic polarity adjacent one another. In the embodiment shown, two permanent magnets 940, 950 form a first magnet assembly. The ends 944, 954 having a positive magnetic polarity are adjacent the diaphragm 910. Two additional magnets 920, 930 form a second magnet assembly. Another two magnets 960, 970 form a third magnet assembly. The first magnet assembly is between the second and third magnet assemblies. The second and third magnet assemblies are coupled to the two magnetically permeable plates 902, 904 with the ends 924, 934, 964, 974 of the magnets 920, 930, 960, 970 having a positive magnetic polarity adjacent the two magnetically permeable plates. Thus the adjacent pairs of magnetic assemblies are arranged with opposite magnet polarities.

Each of the magnetic assemblies passes through its own opening in the diaphragm 910. Each opening is spaced apart from the other openings in the diaphragm. A voice coil 922, 942, 962 surrounds each opening in the diaphragm 910 to interact with the one of the magnetic assemblies that passes through the voice coil.

A suspension ring 938, 958, 978 may be provided for each opening in the diaphragm 910. The suspension rings 938, 958, 978 may be distributed with some suspension rings sealed to the back side of the diaphragm 910 and the lower magnetically permeable plate 904 and other suspension rings sealed to the front side of the diaphragm and the upper magnetically permeable plate 902. Arranging the suspension rings 938, 958, 978 on both sides of the diaphragm 910 may provide a better distribution of the forces exerted by the suspension rings.

Figure 10:
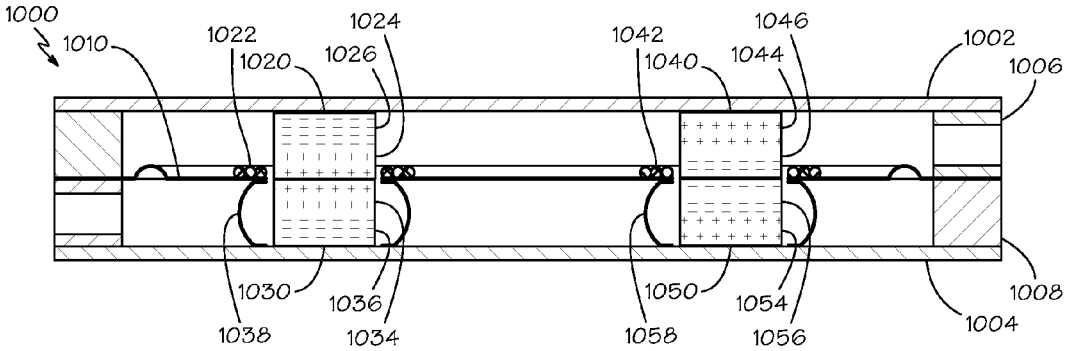
FIG. 10 is a cross-section view of yet another audio speaker.

FIG. 10 is a cross-section view of yet another audio speaker. The embodiment shown provides two magnet assemblies having upper magnets 1020, 1040. It will be appreciated that this cross-section is similar to the three pairs of magnet assemblies found across the short dimension of the embodiment shown in FIG. 8.

The two magnetic assemblies are arranged with opposite magnet polarities. Two permanent magnets 1020, 1030 form a first magnet assembly. The ends 1024, 1034 having a positive magnetic polarity are adjacent the diaphragm 1010. Another two magnets 1040, 1050 form a second magnet assembly. The ends 1044, 1054 having a positive magnetic polarity are coupled to the two magnetically permeable plates 1002, 1004. The structure of this embodiment is otherwise similar to the previously described embodiments.

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

What is claimed is:

1. An audio speaker, comprising:

two magnetically permeable plates in a parallel, spaced apart relationship;

a diaphragm supported between the two magnetically permeable plates to define a front volume on a first side of the diaphragm and a back volume on a second side of the diaphragm opposite the first side;

a first magnet assembly coupled to the two magnetically permeable plates and passing through a first opening in the diaphragm, the first magnet assembly including two magnets that are coupled with two like poles adjacent the diaphragm;

a pleated first suspension ring that surrounds a portion of the first magnet assembly with a first end sealed to the diaphragm and an opposing second end sealed to one of the two magnetically permeable plates to separate the back volume from the front volume; and a first voice coil coupled to the diaphragm and surrounding the first opening in the diaphragm through which the first magnet assembly passes.

2. The audio speaker of claim 1 further comprising:

a second magnet assembly coupled to the two magnetically permeable plates and passing through a second opening in the diaphragm, the second magnet assembly including two magnets that are coupled with the two like poles adjacent the two magnetically permeable plates; and a second voice coil coupled to the diaphragm and surrounding the second opening in the diaphragm.

3. The audio speaker of claim 1 further comprising:

second and third magnet assemblies coupled to the two magnetically permeable plates and passing through second and third openings in the diaphragm such that the first magnet assembly is between the second and third magnet assemblies, the second and third magnet assemblies each including two magnets that are coupled with the two like poles adjacent the two magnetically permeable plates; and second and third voice coils coupled to the diaphragm and surrounding the second and third openings in the diaphragm through which the second and third magnet assemblies pass.

4. The audio speaker of claim 1 wherein the front volume is vented to atmosphere.

5. The audio speaker of claim 1 further comprising two frame members that support the two magnetically permeable plates and capture a periphery of the diaphragm between the two frame members.

6. The audio speaker of claim 5 wherein the front volume is vented to atmosphere through a third opening in one of the two frame members.

7. The audio speaker of claim 6 wherein the audio speaker is in a housing and the third opening is coupled to a port in a wall of the housing.

8. The audio speaker of claim 7 wherein the back volume is vented to a closed volume in the housing.

9. A device comprising:

a housing; and an audio speaker enclosed in the housing, the audio speaker including two magnetically permeable plates in a parallel, spaced apart relationship, a diaphragm supported between the two magnetically permeable plates to define a front volume on a first side of the diaphragm and a back volume on a second side of the diaphragm opposite the first side, a magnet assembly coupled to the two magnetically permeable plates and passing through an opening in the diaphragm, the magnet assembly including two magnets that are coupled with two like poles adjacent the diaphragm, a voice coil coupled to the diaphragm and surrounding the opening in the diaphragm through which the magnet assembly passes, and a suspension ring that surrounds a portion of the magnet assembly with a first end sealed to the diaphragm and an opposing second end sealed to one of the two magnetically permeable plates to separate the back volume from the front volume.

10. The device of claim 9 wherein the front volume of the audio speaker is vented to atmosphere through a port in a wall of the housing.

11. The device of claim 9 wherein the audio speaker further comprises two frame members that support the two magnetically permeable plates and capture a periphery of the diaphragm between the two frame members.

12. The device of claim 11 wherein the front volume of the audio speaker is vented to atmosphere through a first opening in one of the two frame members that is sealed to a port in a wall of the housing.

13. The device of claim 12 wherein the back volume of the audio speaker is vented to a closed volume in the housing.

14. The device of claim 9 wherein the suspension ring of the audio speaker is pleated.

15. The device of claim 9 wherein the diaphragm includes a surround that movably supports a center portion of the diaphragm.

16. An audio speaker, comprising:

two magnetically permeable plates in a parallel, spaced apart relationship;

a diaphragm;

means for movably supporting the diaphragm between the two magnetically permeable plates to define a front volume on a first side of the diaphragm and a back volume on a second side of the diaphragm opposite the first side;

a magnet assembly coupled to the two magnetically permeable plates and passing through an opening in the diaphragm, the magnet assembly including two magnets that are coupled with two like poles adjacent the diaphragm;

a voice coil coupled to the diaphragm and surrounding the opening in the diaphragm through which the magnet assembly passes; and means for separating the back volume from the front volume.

17. The audio speaker of claim 16 wherein the front volume is vented to atmosphere.

18. The audio speaker of claim 16 further comprising two frame members that support the two magnetically permeable plates and capture a periphery of the diaphragm between the two frame members.

19. The audio speaker of claim 18 wherein the front volume is vented to atmosphere through a first opening in one of the two frame members.

20. The audio speaker of claim 19 wherein the audio speaker is in a housing and the opening in one of the two frame members is coupled to a port in a wall of the housing.

21. The audio speaker of claim 20 wherein the back volume is vented to a closed volume in the housing.

* * * * *